US007506999B2

(12) United States Patent
Uchida et al.

(10) Patent No.: US 7,506,999 B2
(45) Date of Patent: Mar. 24, 2009

(54) LIGHTING DEVICE

(75) Inventors: Daisuke Uchida, Tokyo (JP); Toshiyuki Kondo, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 0 days.

(21) Appl. No.: 11/678,764

(22) Filed: Feb. 26, 2007

(65) Prior Publication Data

US 2007/0201230 A1 Aug. 30, 2007

(30) Foreign Application Priority Data

Feb. 28, 2006 (JP) ..... 2006-052381

(51) Int. Cl.
*F21V 5/00* (2006.01)

(52) U.S. Cl. ..... 362/245; 362/268; 362/309; 362/328; 362/331; 362/332

(58) Field of Classification Search ..... 362/245, 362/268, 308, 309, 328, 330–332, 343; 313/111
See application file for complete search history.

(56) References Cited

U.S. PATENT DOCUMENTS 6,688,756 B1 * 2/2004 Akiyama ..... 362/268
6,827,467 B2 * 12/2004 Tenmyo ..... 362/268

FOREIGN PATENT DOCUMENTS

JP 2002299697 10/2002

* cited by examiner

*Primary Examiner*—Stephen F Husar
(74) *Attorney, Agent, or Firm*—Cermak Kenealy Vaidya & Nakajima LLP

(57) ABSTRACT

A lighting device can include a light source in line and a reflector behind the light source. In front of the light source, a transparent inner lens and a transparent outer lens can be provided with a gap formed therebetween. The shape of the lens can be defined by bending a plate member so as to have a projection portion that surrounds or opens towards the light source. The inner lens and the outer lens can each have a flat part at a position opposite the light source and in the illumination direction. When observed from different positions, the light source can appear as if it is displaced or deformed.

18 Claims, 4 Drawing Sheets

LIGHTING DEVICE

This application claims the priority benefit under 35 U.S.C. § 119 of Japanese Patent Application No. 2006-052381 filed on Feb. 28, 2006, which is hereby incorporated in its entirety by reference.

BACKGROUND

1. Field

The disclosed subject matter relates to a lighting device for use in a vehicle light such as a stop lamp, an illumination lamp for interior illumination, and the like. In particular, the disclosed subject matter relates to a lighting device with lighter weight and improved outer appearance.

2. Description of the Related Art

FIG. 1 shows a conventional exemplary configuration of a lighting device 90 of this type. The lighting device 90 can include a substrate 91, LED chips 92 mounted on the substrate 91, and a transparent resin part 93 which covers the chips 92. The substrate 91 is formed of a conductive material such as a metal material having superior heat conductivity. The substrate 91 may be rectangular. The plurality of LED chips 92 is mounted in line in the lengthwise direction of the substrate 91. The transparent resin part 93 is substantially semi-cylindrical or barrel roof shaped.

In this case, a set including a red-light emitting LED chip, a green-light emitting LED chip, and a blue-light emitting LED chip is used as the LED chip 92, and are mounted on the substrate 91 such that they are in close proximity to each other. The surface of the transparent resin part 93 may be subjected to matte finish. In this lighting device 90, when light emitted from the respective LED chips pass through the transparent resin part 93, the red, green, and blue light beams are mixed with each other to provide pseudo white light.

Since the LED chips 92 are mounted on the heat-conductive substrate 91, even when they are mounted in close proximity to each other, the heat dissipation property of the lighting device may not deteriorate as compared to the case where lamp-type (cannonball shaped) LEDs are used. This can provide a brighter lighting device (see, for example, Japanese Patent Laid-Open Publication No. 2002-299697).

In this lighting device 90 configured as described above, the transparent resin part 93 with the semi-cylindrical shape is formed by filling the space close to the surfaces of the LED chips 92 with a transparent resin material. Therefore, a substantial amount of resin material is required. The resin material for use in this lighting device application is required to have a particular transparency, durability, water-resistance, and the like, which increases the material cost. This affects the entire cost for manufacturing the lighting device.

Furthermore, in this instance, the LED chips 92 are covered with the transparent resin part 93 under equal optical conditions across the emitting area of the device 90. Accordingly, it is difficult to provide special effects such as a light source displacement effect wherein one can see the light source as if it is displaced at different observation positions. Therefore, when turned on, the light source is not varied when observed at different positions. This means it has a monotonous appearance and is not decorative.

SUMMARY

In view of the above-described and other issues and problems, according to an aspect of the disclosed subject matter, a lighting device can be provided for use in a vehicle light such as a stop lamp, an illumination lamp for interior illumination, and the like, that has a relatively light weight and unique and different outer appearance.

Another aspect of the presently disclosed subject matter is a lighting device which can include: at least one light source; a reflector located behind the light source; an inner lens located in front of the light source, the inner lens being formed of a transparent material so as to show a convex shape such that the cross section of the lens surrounds the light source; and an outer lens located in front of the inner lens, the outer lens being formed of a transparent material so as to show a convex shape like the inner lens such that the cross section of the lens surrounds the light source. In this lighting device, the inner lens and the outer lens are located with a predetermined gap therebetween, and each of the inner lens and the outer lens has a flat part at a position opposite to the light source, the flat part being substantially perpendicular to an illumination direction.

In the lighting device described above, the gap between the inner lens and the outer lens can be varied by changing the thickness of either the inner lens or the outer lens. In this case, the thickness may be changed linearly or curvedly.

In the lighting device described above, a part of the outer lens may have a lens cut part.

In accordance with another aspect of the disclosed subject matter, an illumination device can include a plurality of the lighting devices, described above, which are arranged in parallel and in which the flat parts are flush with each other so as to serve as a surface light source.

Still another aspect of the disclosed subject matter is a lighting device which can include: at least one light source; a reflector located behind the light source; and at least one lens located in front of the light source, the lens being formed of a transparent material so as to show a convex shape such that the cross section of the lens surrounds the light source, the lens having a flat part at a position opposite to the light source, the flat part being substantially perpendicular to an illumination direction, the thickness of the lens other than the flat part being changed.

In the lighting device as described above, the thickness of the lens may be changed linearly or curvedly. Furthermore, a part of the lens may have a lens cut part.

According to the disclosed subject matter, when viewed from different observation positions, one can see the light source as if it is displaced or deformed so that variation in appearance of the lighting device can be achieved with improved decoration. Since the adopted inner and/or outer lenses may be formed from a thin plate material, the required amount of resin material can be reduced and any shrink problem during resin-molding may be prevented. Furthermore, the lenses can be formed by a common manufacturing method such as injection molding, resulting in a reduced manufacturing cost.

BRIEF DESCRIPTION OF THE DRAWINGS

These and other characteristics, features, and advantages of the disclosed subject matter will become clear from the following description with reference to the accompanying drawings, wherein.

DETAILED DESCRIPTION OF EXEMPLARY EMBODIMENTS

Figure 1:
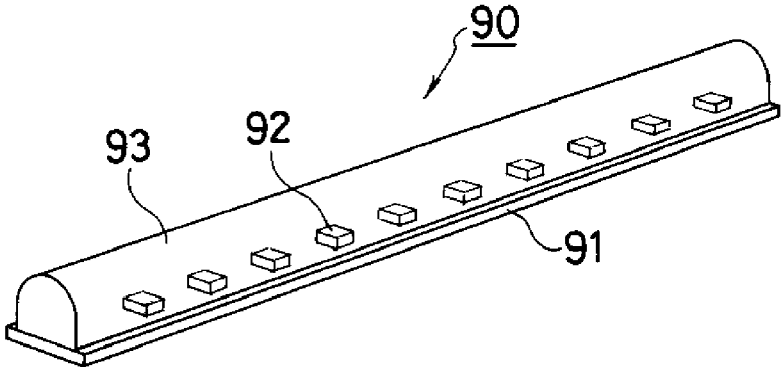
Fig. 1 Conventional Art
FIG. 1 is an explanatory view showing a conventional exemplary lighting device.
Figure 2:
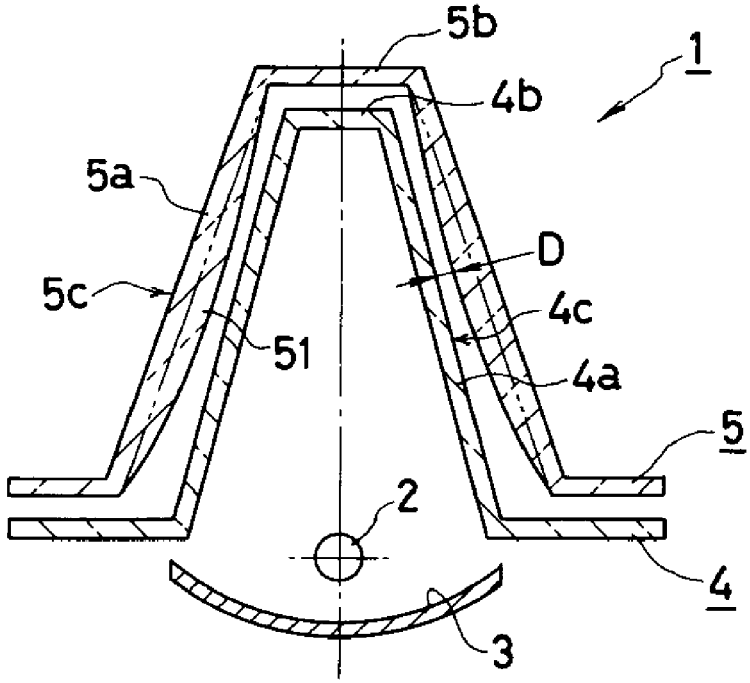
FIG. 2 is a cross sectional view showing an exemplary embodiment of a lighting device made in accordance with principles of the presently disclosed subject matter.

Hereinafter, a description will be given of exemplary embodiments of lighting devices made in accordance with principles of the presently disclosed subject matter. In FIG. 2, the reference numeral 1 denotes a lighting device made in accordance with principles of the disclosed subject matter. The lighting device 1 is configured to include a light source 2, a reflector 3, an inner lens 4, and an outer lens 5. Examples of the light source 2 can include an LED chip, a cold cathode discharge tube, and the like. The reflector 3 can reflect the light emitted from the light source 2 to direct the light to a desired direction, for example, upward in the illustrated example. The inner lens 4 is provided in an illumination direction of light from the reflector 3 and can be formed by bending or otherwise shaping a transparent plate member into a shape in which a cross section shows a trapezoid with a projecting part 4*a*. The outer lens 5 is provided in front of the inner lens 4 with an appropriate gap therebetween and is configured to have a similar trapezoidal cross section as compared to that of the inner lens 4, with a projecting part 5*a*.

The projecting part 4*a* (5*a*) can include a flat part 4*b* (5*b*) at its top and main light-emitting part 4*c* (5*c*) extending from either end of the flat part 4*b* (5*b*) toward the light source side.

The inner lens 4 and the outer lens 5 can be molded by injection molding a resin material. In this way, the inner lens 4 and the outer lens 5 can be formed into a substantially box shape with an opening at the light source 2 (reflector 3) side. Furthermore, the injection molding of a resin material can form thickness variations in the inner lens 4 and/or the outer lens 5 so as to vary the distance D between the inner lens 4 and the outer lens 5.

In this configuration, when light that is emitted directly from the light source 2 or that is reflected by the reflector 3 is incident on the flat parts 4*b* and 5*b* which are provided in front of the light source 2, the incident light is radiated in the forward direction without (or substantially without) refraction. When one observes the lighting device 1 from outside and through the flat parts 4*b* and 5*b*, one can see the light source 2 without deformation and/or displacement thereof.

In this exemplary embodiment, a convex additional lens part 51 is provided on the inner surface of each of the main light-emitting parts 5*c* of the outer lens 5. When one observes the light source 2 from outside and through these parts while moving one's observation position, the light source 2 can be observed as if its mounting position is moved due to the refraction function of the additional lens parts 51. This can improve its appearance.

Figure 3:
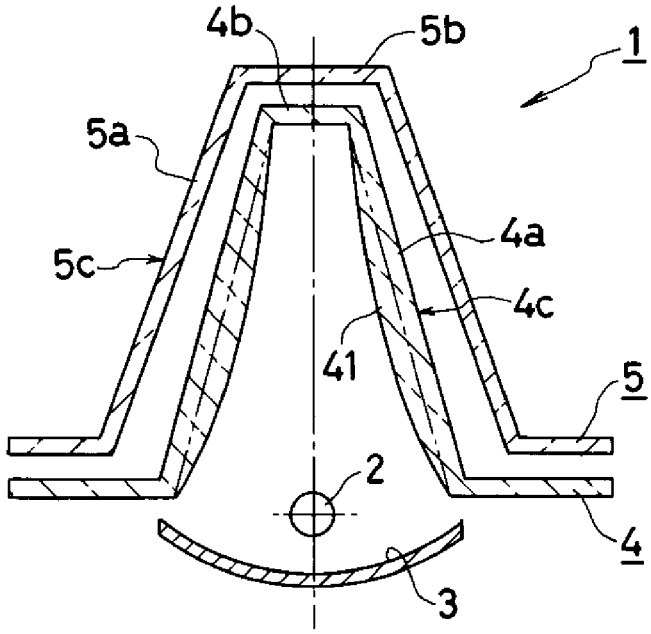
FIG. 3 is an explanatory view showing one variation of a position where an additional lens part is provided in the exemplary embodiment of FIG. 2.
Figure 4:
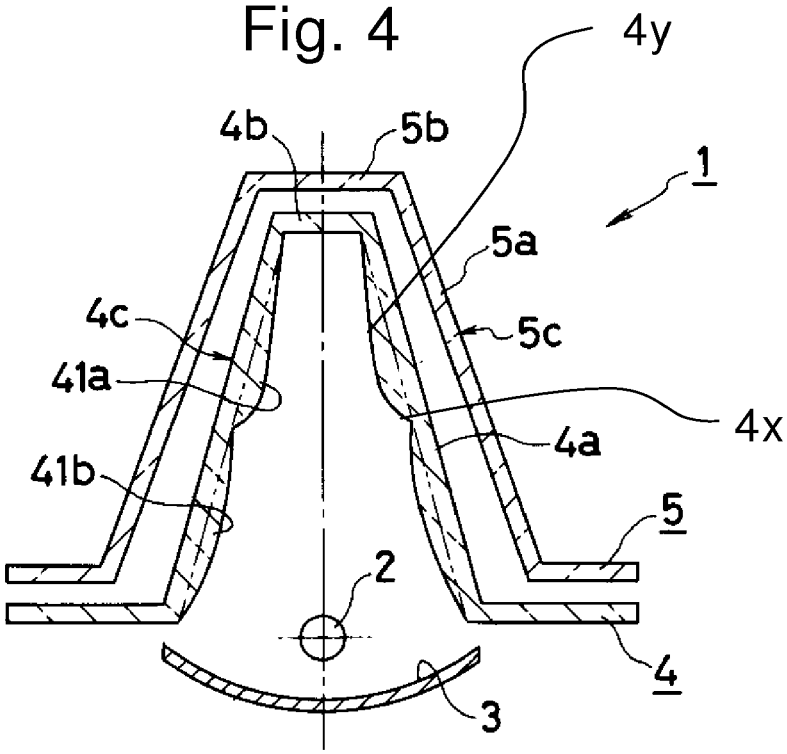
FIG. 4 is an explanatory view showing one variation of a shape of the additional lens part in the exemplary embodiment of FIG. 2.

In this exemplary embodiment, the additional lens parts 51 are formed over substantially the entire inner surface of the main light-emitting parts 5*c* of the outer lens 5. However, the present invention is not limited to this embodiment. Alternatively, the additional lens part may be provided on an outer surface of the main light-emitting parts 5*c* of the outer lens 5, on both inner and outer surfaces of the main light-emitting parts 5*c*, on an inner surface of the main light-emitting parts 4*c* of the inner lens 4 (see the reference numeral 41 of FIG. 3), on an outer surface of the main light-emitting parts 4*c*, on both inner and outer surfaces of parts 4*c*, on a part of the surfaces of the main light-emitting parts 4*c* and/or 5*c*, and/or on a plurality of parts of the above-referenced surfaces (see the reference numerals 41*a* and 41*b* of FIG. 4). In addition, the additional lens parts 41 can vary in thickness linearly as shown at portion 4*x* or in a curved fashion as shown at portion 4*y*, or both. Of course, portions 4*x* and 4*y* are merely exemplary, and it should be understood that the thickness can change in other more linear or even more curved fashions. For example, the thickness can step up or down in linear stepped increments, or flow in and out similar to a curved sinusoidal wave, etc.

In the above-mentioned exemplary embodiment, the additional lens parts 51 are formed in the lengthwise direction of the outer lens 5 as a semi-cylindrical lens. However, the disclosed subject matter is not limited to this embodiment. Alternatively, the cross section of the additional lens part 51 may show parts of ellipse, parabola, or hyperbola with a convex or concave face. Further, the thickness of the main light-emitting parts 4*c* and/or 5*c* may be linearly varied entirely or in part to provide a prismatic function.

Figure 5:
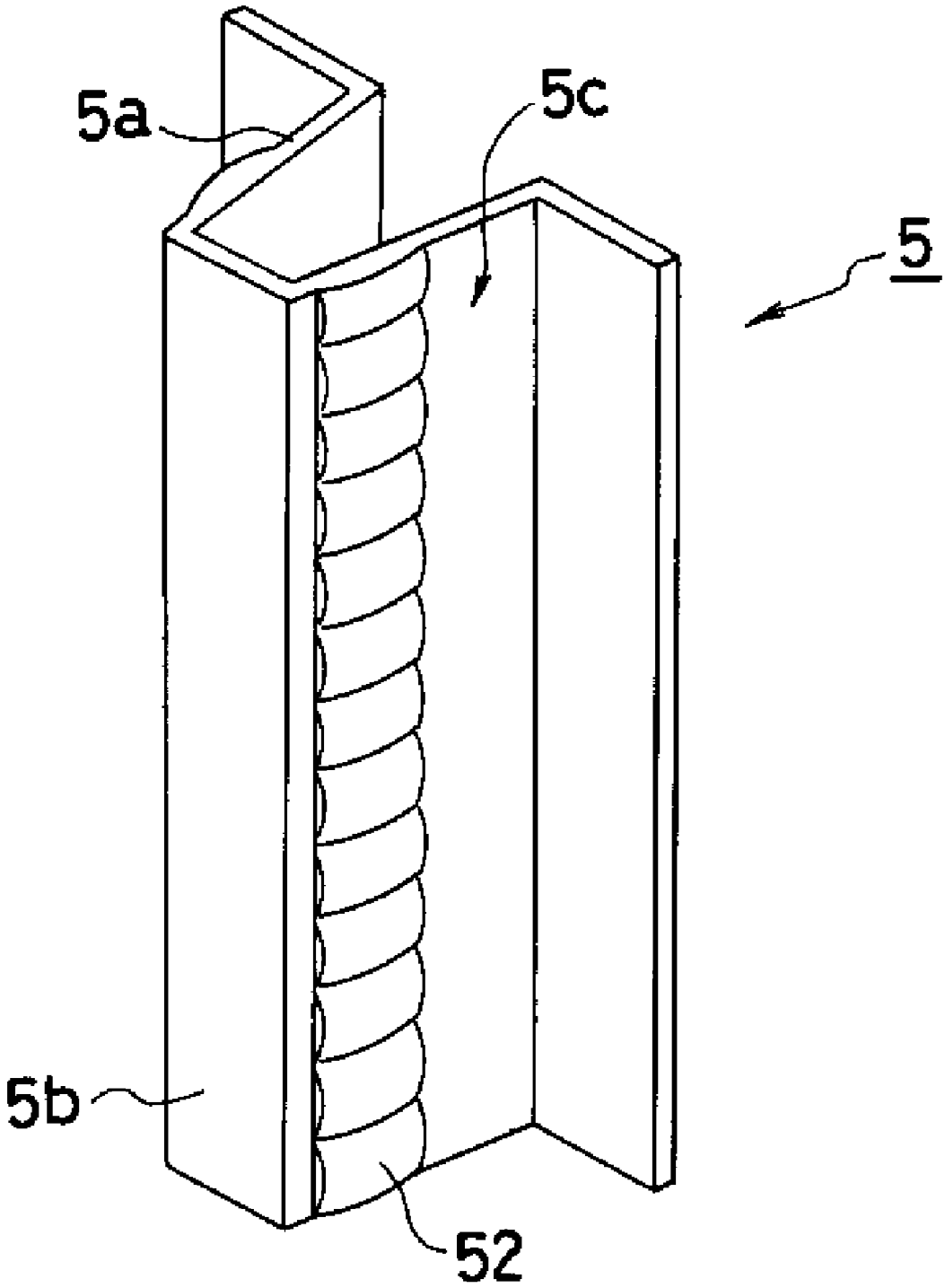
FIG. 5 is a perspective view showing another exemplary embodiment of a lighting device made in accordance with principles of the disclosed subject matter.

In the previous exemplary embodiment, the main light-emitting parts 5*c* (4*c*) are provided with an additional lens part 51 (41) showing a cross section with an arc. Therefore, the additional lens part 51 (41) itself does not have any significant aesthetic function (appearance variation or the like). In view of this point, another exemplary embodiment of the disclosed subject matter is shown in FIG. 5.

The illustrated exemplary embodiment can improve this point by providing lens cut parts 52 (such as fish-eye lens shape) to parts of the main light-emitting parts 5*c* near the flat part 5*b* of the outer lens 5. In this case, the lens cut parts 52 may be formed on either the outer face or inner face of the main light-emitting part 5*c*.

In this manner, the present exemplary embodiment can provide a different aesthetic feature as compared to the previous exemplary embodiment. Furthermore, individual parts of the lens cut part 52 can each be formed with a curved surface with a relatively small radius. This configuration can provide a larger diffusion angle in the case where the emitted light should be diffused.

It should be appreciated that the lens cut part can be provided on the inner lens 4 instead of or in addition to the outer lens 5. Also, the lens cut part can be provided not only on the portions close to the flat part 5*b* (4*b*), but also on the portions close to the light source 2, or on the entire surface of the main light-emitting part 5*c* (4*c*). This can be set depending on its specification.

Figure 6:
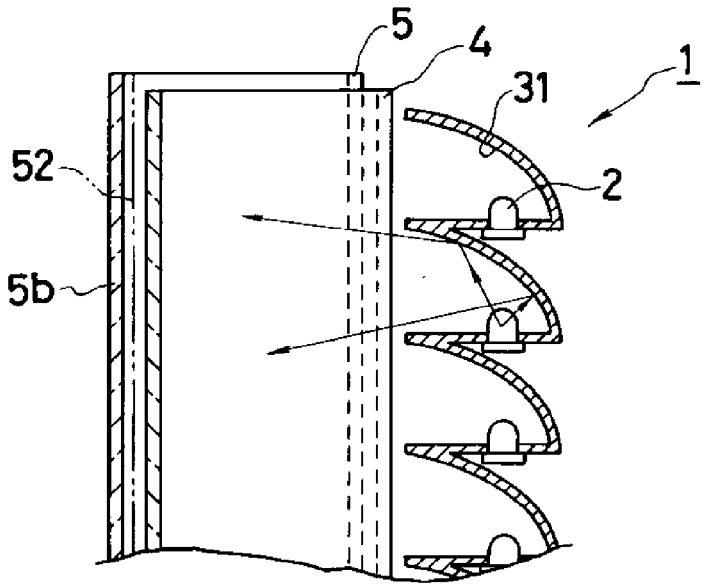
FIG. 6 is a perspective view showing yet another embodiment of a lighting device made in accordance with principles of the disclosed subject matter.

FIG. 6 shows still another exemplary embodiment of the disclosed subject matter. In the previous exemplary embodiments, a plurality of light sources 2 is arranged in line on a reflector 3 which has a single continuous surface for reflection. According to the exemplary embodiment shown in FIG. 6, a single light source 2 and a corresponding single reflector 31 are used as a combination such that the light from the light source 2 can be properly reflected by the reflector 31 toward the inner lens 4 and the outer lens 5.

Examples of the reflector 31 can include a revolved parabolic surface and the like. When the light source 2 is located at the focus of the revolved parabolic surface, the light reflected by the reflector 31 becomes substantially parallel light that is incident on the outer lens 5. Therefore, even when no inner lens is used, for example, the flat part 5*b* of the outer lens 5 may have lens cut parts 52 formed thereon to improve the accuracy of the light distribution property of the lighting device 1.

In this instance, almost all of the light emitted from the light source 2 is incident on the reflector 31 and reflected thereby toward the outer lens 5. This means the light emitted from the light source 2 is captured by the revolved parabola reflector 31 such that the light is collimated to pass through the outer lens 5. Therefore, the light utilization efficiency can be improved. If the same amount of light is sufficient for illumination purpose, the number of light sources 2 can be decreased due to the improved light utilization efficiency, thereby achieving a reduction in required power as well as cost.

Figure 7:
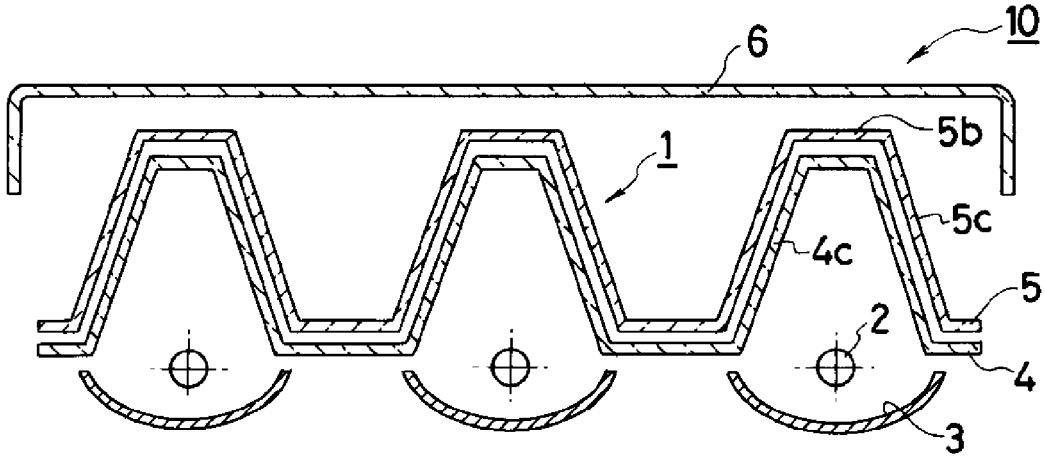
FIG. 7 is a perspective view showing another embodiment of a lighting device made in accordance with principles of the disclosed subject matter.

In the previous exemplary embodiments, a single outer lens or a combination of an inner lens 4 and an outer lens 5 is used in the lighting device 1. However, the present invention is not limited thereto. FIG. 7 shows still another exemplary embodiment. A plurality of lighting devices 1 is arranged in parallel to each other such that the respective flat parts 5*b* are flush with each other. This constitutes a lighting device 10 that can function as a surface light source.

In this case, a transparent cover lens 6 may be provided in front of the outer lenses 5 so as to provide an integrated appearance to the lighting device 10. In this way, when, for example, the lighting device 10 is used as a vehicle lighting device such as a tail lamp or the like, it is possible to adjust the number of the combined lighting devices 1, thereby providing a required light-emitting area.

The action and effect of the embodiment will be described when the outer lens 5 has a flat part 5*b* with its lengthwise direction being aligned with the horizontal direction. In this case, the flat part 5*b* transmits light received directly from the light source. Therefore, even when a fish-eye lens cut is provided in the outer lens 5 for the purpose of adjusting an illumination angle, the light can be observed by a driver of a rear-side automobile without any sense of discomfort.

However, the light emitted from the main light-emitting parts 4*c* or 5*c* toward the rear-side automobile can appear as if the light source is displaced when viewed from different distance, angle or the like with respect to the automobile of interest. This can provide a fresh appearance feature to the driver of the rear-side automobile.

The lighting devices are exemplified as a vehicle light, but the presently disclosed subject matter is not limited thereto. For example, the lighting device 10 shown in FIG. 7 can be used as an interior illumination device. In this case, the light emitted from the flat part 4*b* or 5*b* can be projected onto a floor with uniform intensity, and at the same time a moving observer can observe the lighting device that includes a unique appearance feature in which the lighting position seen through the main light-emitting parts 4*c*, 5*c* is fluctuated. This can provide an improved illumination effect which cannot be achieved by a common lighting device.

While there has been described what are at present considered to be exemplary embodiments of the invention, it will be understood that various modifications may be made thereto, and it is intended that the appended claims cover such modifications as fall within the true spirit and scope of the invention.

What is claimed is:

1. A lighting device configured to emit light in an illumination direction comprising:

at least one light source;

a reflector located behind the light source with respect to the illumination direction;

an inner lens located in front of the light source, the inner lens being formed of a transparent material and configured in a convex shape such that a cross section of the inner lens is open towards the light source; and an outer lens located in front of the inner lens, the outer lens being formed of a transparent material and configured in a convex shape such that a cross section of the outer lens is open towards the light source, the inner lens and the outer lens being located with a predetermined gap therebetween, and each of the inner lens and the outer lens having a substantially flat part at a position opposite to the light source, the flat parts being substantially perpendicular to the illumination direction.

2. The lighting device according to claim 1, wherein the gap between the inner lens and the outer lens varies in accordance with a change in the thickness of at least one of the inner lens and the outer lens.

3. The lighting device according to claim 2, wherein the thickness changes linearly.

4. The lighting device according to claim 2, wherein the thickness changes curvedly.

5. The lighting device according to claim 1, wherein the outer lens includes a lens cut part.

6. The lighting device according to claim 2, wherein the outer lens includes a lens cut part.

7. The lighting device according to claim 3, wherein the outer lens includes a lens cut part.

8. The lighting device according to claim 4, wherein the outer lens includes a lens cut part.

9. An illumination device comprising a plurality of the lighting devices according to claim 1, at least one of the plurality of lighting devices being arranged in parallel with a second of the plurality of lighting devices, and the flat part of the one of the plurality of lighting devices is substantially co-planar with the flat part of the second of the plurality of lighting devices so as to serve as a surface light source.

10. The lighting device according to claim 1, wherein the outer lens and the inner lens surround the light source.

11. The lighting device according to claim 1, wherein the convex shape of the outer lens is the same as the convex shape of the inner lens.

12. The lighting device according to claim 1, wherein the outer lens and the inner lens surround the light source.

13. A lighting device configured to emit light in an illumination direction comprising:

at least one light source;

a reflector located behind the light source with respect to the illumination direction; and at least one lens located in front of the light source, the lens being formed of a transparent material and including a convex shape portion such that a cross section of the lens is open towards the light source, the lens having a substantially flat part at a position opposite to the light source, the flat part being substantially perpendicular to the illumination direction, and a thickness of a first portion of the lens other than the flat part varies, and the lens having a second flat part at a position opposite to the light source and closer to the light source than the flat part, the second flat part being substantially perpendicular to the illumination direction and substantially parallel with the flat part.

14. The lighting device according to claim 13, wherein the thickness of the first portion of the lens varies linearly.

15. The lighting device according to claim 14, wherein the thickness of the first portion of the lens varies curvedly.

16. The lighting device according to claim 13, wherein the lens includes a lens cut part.

17. The lighting device according to claim 13, further comprising:

a second lens that is configured in a convex shape as viewed from a position spaced from the lighting device along the illumination direction, and is configured in a concave shape facing the light source.

18. A lighting device configured to emit light in an illumination direction comprising:

at least one light source;

a reflector located behind the light source with respect to the illumination direction; and at least one lens located in front of the light source, the lens being formed of a transparent material and includin2 a convex shape portion such that a cross section of the lens is open towards the light source, the lens having a substantially flat part at a position opposite to the light source, the flat part being substantially perpendicular to the illumination direction, and a thickness of a first portion of the lens other than the flat part varies, wherein the at least one lens includes a plurality of convex shape portions and a plurality of substantially flat pails, and includes a plurality of light sources each located adjacent to and configured to emit light towards at least one of the substantially flat parts.

* * * * *